US011472203B2

(12) United States Patent
Raisanen et al.

(10) Patent No.: US 11,472,203 B2
(45) Date of Patent: Oct. 18, 2022

(54) PRINT CONDITIONER

(71) Applicant: HEWLETT-PACKARD DEVELOPMENT COMPANY, L.P., Spring, TX (US)

(72) Inventors: Matthew Raisanen, Vancouver, WA (US); Kevin Lo, Vancouver, WA (US); Stephen Thomas Rohman, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/500,399

(22) PCT Filed: Jun. 29, 2018

(86) PCT No.: PCT/US2018/040387
§ 371 (c)(1),
(2) Date: Oct. 2, 2019

(87) PCT Pub. No.: WO2020/005287
PCT Pub. Date: Jan. 1, 2020

(65) Prior Publication Data

US 2021/0354480 A1 Nov. 18, 2021

(51) Int. Cl.
*B41J 29/38* (2006.01)
*B41J 11/00* (2006.01)
(Continued)

(52) U.S. Cl.
CPC ..... *B41J 11/00222* (2021.01); *B41F 23/08* (2013.01); *B41J 11/002* (2013.01); *B41J 11/009* (2013.01); *B41J 11/425* (2013.01)

(58) Field of Classification Search
CPC ..... B41J 3/60; B41J 23/08; B41J 11/0022; B65H 9/008
See application file for complete search history.

(56) References Cited

U.S. PATENT DOCUMENTS 2,370,811 A 3/1945 Harty
2,658,432 A 11/1953 Baumgartner
(Continued)

FOREIGN PATENT DOCUMENTS

DE 102010062144 B4 11/2015

*Primary Examiner* — Lam S Nguyen
(74) *Attorney, Agent, or Firm* — Dicke Billig & Czaja PLLC

(57) ABSTRACT

Some examples include a print system including a memory to store instructions and print data of a print job, a processor to execute the instructions in the memory to reference print data of a print job, determine a print parameter of the print job, and transform the print data and the print parameter into a conditioning modifier. The print system includes a print engine to dispense a print substance on a medium based on the print data to generate printed medium, and a conditioner to apply heat and pressure to the printed medium, the conditioner including a pressure roller assembly, and a controller to selectively increase a transport speed the pressure roller assembly based on the conditioning modifier and a position of the printed medium relative to the pressure roller assembly to selectively increase the speed of the printed medium through the conditioner.

13 Claims, 4 Drawing Sheets

(51) Int. Cl.
*B41F 23/08* (2006.01)
*B41J 11/42* (2006.01)

(56) References Cited

U.S. PATENT DOCUMENTS

| | | | | |
|---|---|---|---|---|
| 4,469,026 | A | 9/1984 | Irwin | |
| 4,701,857 | A | 10/1987 | Robinson | |
| 5,214,442 | A | 5/1993 | Roller | |
| 6,001,421 | A | 12/1999 | Ahonen et al. | |
| 6,149,327 | A | 11/2000 | Ward et al. | |
| 8,172,218 | B2 * | 5/2012 | Suzuki | B65H 9/008 271/265.01 |
| 9,039,161 | B2 | 5/2015 | Itogawa | |
| 9,460,375 | B2 | 10/2016 | Bayona et al. | |
| 2004/0206260 | A1 | 10/2004 | Pitz | |
| 2007/0273394 | A1 | 11/2007 | Tanner et al. | |
| 2011/0206841 | A1 | 8/2011 | Vilella | |
| 2013/0300794 | A1 | 11/2013 | Leighton et al. | |
| 2013/0333580 | A1 | 12/2013 | Peieg et al. | |
| 2014/0210897 | A1 | 7/2014 | Koehler et al. | |
| 2015/0210096 | A1 * | 7/2015 | Studer | B41J 3/60 347/16 |
| 2015/0346659 | A1 * | 12/2015 | Nagayama | G03G 15/2039 101/424.1 |
| 2016/0358050 | A1 | 12/2016 | Borrell Bayona et al. | |
| 2017/0212716 | A1 | 7/2017 | Klomp et al. | |

* cited by examiner

PRINT CONDITIONER

BACKGROUND

Imaging systems, such as printers, copiers, etc., may be used to form markings on a physical medium, such as text, images, etc. An imaging system can perform two-dimensional or three-dimensional printing operations. In some examples, imaging systems may form markings on the physical medium by performing a print job. A print job can include forming markings such as text and/or images by transferring a print substance (e.g., ink, toner, etc.) to the physical medium. Imaging device, such as inkjet printers, include a print path where printing operations are performed.

DETAILED DESCRIPTION

Figure 1:
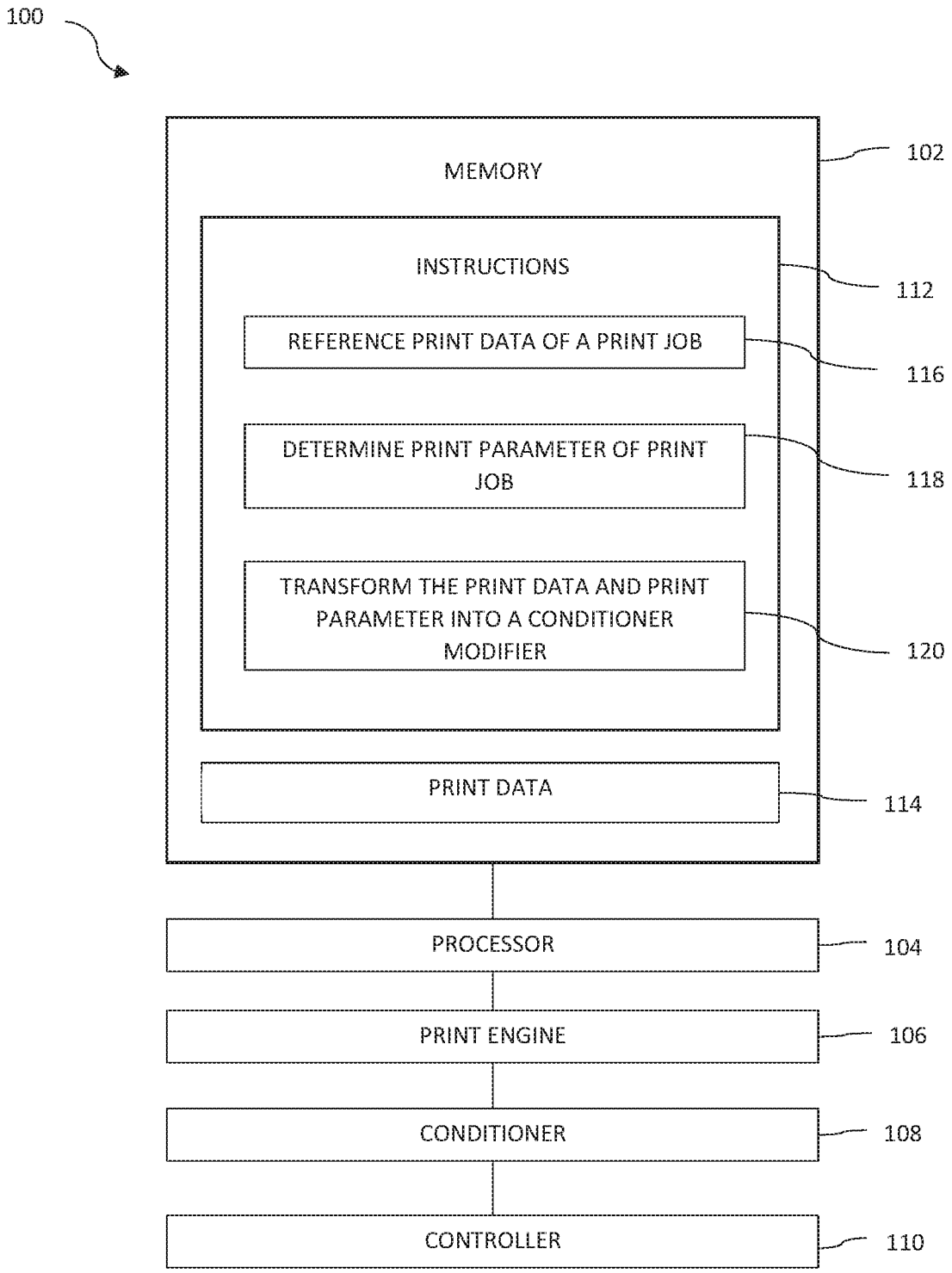
FIG. 1 is a block diagram of an example imaging system in accordance with aspects of the present disclosure.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

In general, imaging devices can create physical representations, patterns, or images by depositing a print substance on a print medium in a desired pattern. Imaging devices can deposit the print substance onto the physical medium during an imaging or printing process. In some examples, imaging devices deposit quantities of the print substance onto the printable medium based on job attributes, or print parameter, of a print job. A print parameter represents a characteristic of a print job. Some example print parameters include print settings, user interface (UI) settings, a print substance type, a media type, a page size, a page orientation, a content class, a number of pages, a number of copies, a simplex or duplex (e.g., single or double sided) job option, a grayscale or color option, a stapling option, a hole punching option, a booklet making option, and the like.

The imaging device can include any hardware device with functionalities to physically produce representation(s) (e.g., text, images, models, etc.) on the media. The media can include various types of print media, such as paper, photopolymers, plastics, composite, and can include any suitable object or materials to which a print substance from a printing device can be applied including materials such as powdered build materials for forming three-dimensional articles. Print substances such as printing agents, marking agents, and colorants, can include toner, liquid inks, or other suitable marking materials that may or may not be mixed with fusing agents, detailing agents, or other materials and can be applied to the medium. In some examples, the imaging devices, such as inkjet printers, deposit a liquid print substance that is ejectable from a print head, such as ink, toner, binding agent, or the like. Many liquid print substances are water-based, including latex ink, for example.

The imaging system can include a print engine, a conditioner, and a finisher. The printed medium can be partially "wet" with applied printing substance (e.g., liquid ink) from the print engine. Heating and conditioning can be used to remove distorted properties of the printed media prior to the printed media moving to a finishing device. For example, the printed medium can have distorted properties such as a curl, a cockle, a reduction in stiffness, increase surface roughness, extruded fibers from the surface, misaligned fibers, and/or increased sheet to sheet friction of the media. In some examples, these distorted properties can be caused by printing substance deposited on the medium and the medium absorbing the printing substance. For example, the printing substance can be in a liquid state that can be absorbed by a medium such as paper. The liquid state of the printing substance can cause distorted properties of the medium in a similar manner that other liquids may distort the properties of the medium.

Appropriate print processing, including appropriate dry time can be beneficial to reduce print defects and to maintain a stiffness in the media in order to improve reliability in handling and finishing. In some examples, the imaging system can determine and set dry temperature and pressure applied to the media along the print path. Numerous variable characteristics ultimately affect the drying of a medium, such as area coverage of the print substance, mass of the print substance, thickness of the medium, composition of the medium, composition of the print substance, and environmental factors such as temperature and humidity. In some examples, the imaging system can determine and set throughput speeds (e.g., time it take to print and dry one page before beginning to print a next page) based on the print and environmental characteristics. Generally, dry time is the time that print substance (e.g., ink) on the media has to substantially dry in order that any later manipulations will not cause image quality defects (e.g., ink smears) or finishing defects (e.g., unaligned stapled pages) in the finished print job. Modifying the print process speed along the print path modifies the dry time by exposing the media to drying mechanisms for longer periods of time when the print speed is decreased, or shorter periods of times when the print speed in increased. In some examples, it can be desirable to adjust the dry time along select portions of the print process or path, such as at the conditioner in order to achieve the desired drying effects of the media.

The conditioner can be arranged between the printing device and the finisher in the imaging system (e.g., inkjet printing system). A number of systems and devices can be included with the conditioner. In some examples, the conditioner can include a heated pressure roller assembly to assist with evaporation of liquid portion of the print substance and conditioning of the printed media. In some examples, the conditioner includes a heated pressure roller assembly to apply pressure to a first side of a printed medium and apply heat to a second side of the printed medium. In some examples, the conditioner can include high power heaters. The heating and conditioning can be used to remove distorted properties in the media output from the conditioner for finishing in the finishing device, such as a stapler, hole punch, collator, stacker, etc.

The conditioner can be utilized to increase evaporation of the printing substance applied to the medium and remove or reduce distorted properties from the printed medium. The conditioner can include high power heaters to assist with evaporation of the print substance (e.g., transitioning the print substance from liquid to gas) and conditioning of the printed medium. In some examples, the conditioner can provide more or faster drying (e.g., phase change of liquid to gas) than desired and cause the medium to smile (e.g., curl against a grain of the medium) and/or have cockle.

Techniques in accordance with the present disclosure can be used to mitigate the effect of over drying or too quickly drying the medium that can be otherwise imparted by the conditioning process. Prior to the dispensing of the printing fluid, adjustments to the speed of the medium moving through the conditioner can be determined and selectively increased in order to reduce the drying effects and maintain some moisture in the medium. In some examples, additional phase change control of the print substance from liquid to gas via the conditioner is desired, such as with imaging systems using liquid based print substances. For example, it can be useful in high humidity print environments to assist in controlling the phase change of a liquid print substance through regulation and adjustments to the speed of the medium though the conditioner. In some examples, drying effects of the conditioner can be selectively regulated in order to minimize any distorted properties of the medium.

In some examples, selectively adjusting the print drying process can include selectively adjusting the conditioner (e.g., roller speed) to increase a speed of the medium through the conditioner while maintaining a throughput speed (e.g., images per second (ips) or images per minute (ipm)) along other portions of the print path of the imaging system.

FIG. 1 is a block diagram of an example imaging system 100 in accordance with aspects of the present disclosure. In one example, the imaging system 100 is an inkjet printing system or other suitable printing system that generates printed media to be dried. The imaging system 100 includes a memory 102, a processor 104, a print engine 106, a conditioner 108, and a controller 110. The memory 102 can store instructions 112 and print data 114, or print content, of a print job. The memory 102 can store data, programs, instructions, or any other machine readable data that can be utilized to operate the imaging system 100. The memory 102 can store computer executable instructions 112 such as may be fetched and/or executed by processor 104. The instructions 112 can include a set of instructions 116-120, for example. Instruction 116 can be to reference print data of a print job. Instruction 118 can be to determine a print parameter of the print job. Instruction 120 can be to transform the print data and the print parameter into a conditioner modifier.

The processor 104 can access the memory 102, such as to fetch instructions, and execute the computer executable instructions. The processor 104 can be a computing device and can include an application specific integrated circuit (ASIC), among other things. The processor 104 can execute a set of instructions to implement the operations of the examples included herein. The controller 110 can include a combination of hardware and programming. The controller 110 is operably coupled to the print engine 106 to enable dispensing a print substance onto a medium in response to the print data. The controller 110 is operably coupled to the conditioner 108 to selectively condition the medium after the print substance has been dispensed onto the medium (e.g., printed medium). In some examples, the controller 110 selectively increases a speed of the printed medium through the conditioner 108, as further discussed below. It is noted that in one example, controller 110 may comprise a board with multiple integrated circuits (ICs) and processor 104 may be included on controller 110 or may be external to controller 110. Thus, processor 104 and controller 110 may enable certain functionality either singly or in combination. As should, it should be understood that the recitation of functions of one component (e.g., processor-enable functions) does not necessarily exclude the participation of the other component (e.g., controller-enable functions), and vice versa.

Figure 2:
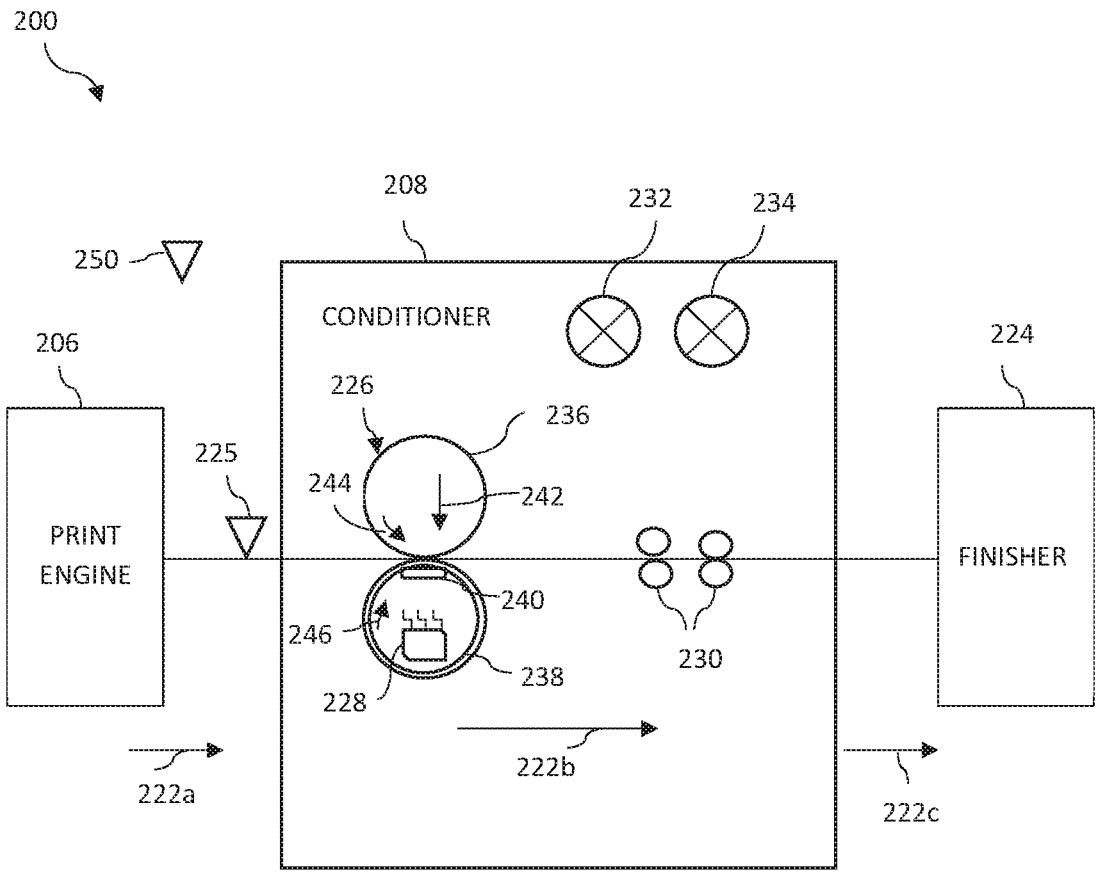
FIG. 2 is a block diagram of an example imaging system including a conditioner in accordance with aspects of the present disclosure.

FIG. 2 is a block diagram of an example imaging system 200 including a conditioner 208 in accordance with aspects of the present disclosure. The imaging system 200 can include an imaging device such as a print engine 206, the conditioner 208, and a finisher 224. In some examples, the conditioner 208 can be arranged between the print engine 206 and the finisher 224. Media can be transported along a print path, such as in a direction indicated by arrows 222*a*, 222*b*, and 222*c*. For instance, media can continue, such as through the print engine 206, to the conditioner 208 and on through to the finisher 224 along the print path, such as in a direction indicated by arrows 222*a*, 222*b*, and 222*c*. The conditioner 208 is operably coupled to the print engine 206 via the print path to receive printed media from the print engine 206 (e.g., arrow 222*a*). The finisher 224 is operably coupled to the conditioner 208 via the print path to operably receive partially or fully dried printed media from the conditioner 208 (e.g., arrow 222*c*). In some examples, the printed medium can be partially dried prior to entering the conditioner 208. For example, the medium can be moved along the print path of the print engine 206, including a dryer (not shown), at a speed that is based on the ink content on the medium to partially dry the printed medium. The partially dried printed medium can exit the print engine 206 and enter the conditioner 208 via the print path. The medium can continue to be moved along the print path through the conditioner 208 for additional drying and conditioning (e.g., arrow 222*b*).

In some examples, a sensor 225 can be positioned to sense a leading edge of the printed medium prior to entering the pressure roller assembly 226. Data related to the sensed position of the printed medium can be transmitted from the sensor 250 to the processor (e.g., processor 104 of FIG. 1) to assist in determining a moment when a transport speed of the conditioner 208 is to be selectively increased, or modified. In some examples, the speed, or movement of the medium along the print path (e.g., shown by arrow 222*a*) prior to the conditioner 208 can be used to determine a timing of when the transport speed of the conditioner 208 is to be selectively increased. In one example, immediately prior to, or as the leading edge of the printed medium enters a pressure roller assembly 226 of the conditioner 208, the rotational speed of the pressure roller assembly 226 is adjusted (e.g., increased) to move the printed medium through the conditioner 208 at a determined speed. In some examples, the speed of the movement of the printed medium through the conditioner is based on a determined print parameter or characteristic, such as the humidity of the print environment, for example.

In some examples, the conditioner 208 can include the pressure roller assembly 226, a heating element 228, a tension roller assembly 230, a vapor fan 232, and a cooling fan 234. In some examples, the pressure roller assembly 226 includes a pressure roller 236, a belt 238, and a platen 240. Pressure can be applied to a top surface of the printed medium by the pressure roller 236 as indicated by arrow 242. A bottom surface of the printed medium can contact the belt 238 over the platen 240. In some examples, the pressure roller 236 rotates in the direction indicated by arrow 244 and belt can rotate in the direction indicated by arrow 246 to draw print media between the pressure roller 236 and the belt 238.

The heating element 228 can apply heat to the pressure roller assembly 226. In one example, the heating element 228 can apply heat to the belt 238 and the belt 238 can apply the heat to the print media. In another example, the pressure roller 236 is heated by a heating element (not shown). In some examples, the heating element 228 supplies and maintains a constant predetermined temperature. In some examples, the heating element 228 can have a first mode for operating at a first predetermined temperature and a second mode for operating at a second predetermined temperature. In one example, the first temperature can be 80 degrees Fahrenheit (° F.) (26 degrees Celsius (° C.)) and the second temperature can be 120° F. (49° C.). Other suitable temperatures are also acceptable. The heating element 228 of the pressure roller assembly 226 can transfer heat to the printed media to effect phase change of the moisture of the printed medium. Regulating the rotational speed of the pressure roller assembly 226 can be utilized to regulate the speed of the medium through the pressure roller assembly 226. By selectively regulating the speed of the medium through the pressure roller assembly 226, heat transfer to the printed medium and phase change of print substance on the printed medium can be selectively controlled for a desired amount of drying of the printed medium.

In some examples, the tension roller assembly 230 can apply tension to the printed medium to at the output of the pressure roller assembly 226. In some examples, the vapor fan 232 can exhaust vapor from the conditioner 208, including evaporated printing fluid due to the drying and phase change of the print substance within the conditioner 208. In some examples, the cooling fan 234 can circulate air within the conditioner 208 to prevent overheating of the components of the conditioner 208. The conditioned print medium can be transferred to the finisher 224 along the print path (e.g., as shown by arrow 222*b*). In some examples, the printed medium is transferred to the finisher 224 along the print path (e.g., in a direction indicated by arrow 222*b*) at a transfer speed that is maintained equivalent to the transfer speed through the conditioner 208.

In some examples, the selectively controlled conditioning process (e.g., media transfer speed) can include adjustments to the transport, or print process, speed of the medium through the conditioner 208 by increasing the rotational speed of the pressure roller 236 and/or belt 238 of the pressure roller assembly 226. By selectively increasing a media transfer speed on print jobs or media pages at the conditioner 208 with select print parameters, an overall maximized print speed can be realized for maximizing throughput images per second (ips) or images per minute (ipm) of the imaging system 200. The operating speed of the heated pressure roller assembly 226 of the conditioner 208 can be adjusted, or calibrated, to assist with controlling the phase change of the moisture content of the printed medium from liquid to gas.

The transfer speed of the pressure roller assembly 226 (e.g., the rotational speed of heated pressure roller 236) can be adjusted based on print parameters or characteristics such as environmental humidity, type of medium (e.g., glossy paper), type of print substance (e.g., water based ink), for example. In one example, a sensor 250 can be utilized to sense the environmental humidity of the print environment. Sensors or user input can be used to determine the type of medium and/or the type of print substance to be used for a print job. A sensor, such as sensor 225, can also be utilized to sense the movement of the media along the print path (e.g., such as in a direction as indicated by arrow 222*a*), through the imaging system 200. Determined print parameters, along with the print data, can be used to generate a conditioning modifier to selectively determine and control the transport speed of the pressure roller assembly 226 and the speed of the printed medium through the conditioner 208.

In some examples, the medium can be transported through the print engine 206 and along a print path (e.g., such as in a direction indicated by arrow 222*a*) at a first transport speed and then transported through the pressure roller assembly 226 and the conditioner 208 to the finisher 224 along the print path (e.g., such as in a direction indicated by arrow 222*b*) at a second transport speed. In some examples, the first transport speed of the media is constant from medium to medium. In other examples, the first transport speed of the media is varied either on a medium-by-medium basis or on a print job basis. In some examples, the second transport speed is selectively increased over the first transport speed in response to the conditioner modifier. In one example, the second transport speed can be maintained by tension roller assembly 230 along the print path to the finisher 224. In one example, the second transport speed along the print path (e.g., such as in a direction indicated by arrow 222*b*) is twice the speed of the first transport speed (e.g., 2:1) along the print path (e.g., such as in a direction indicated by arrow 222*a*). For example, the first transport speed can be 5 ips and the second speed can be 10 ips. Other suitable ratios and media transfer speeds are also acceptable. The second transport speed of the medium along the print path 222*b* can be maintained throughout the conditioner 208 to the finisher 224. The second transport speed can be selectively increased over the first transport speed on a sheet-by-sheet, or medium-by-medium, basis. In some examples, based on the print parameter(s) of the medium (e.g., humidity of the print environment), an increase in transport speed can be determined to be not useful for a particular medium and the second transport speed can remain equivalent to the first transport speed.

Figure 3:
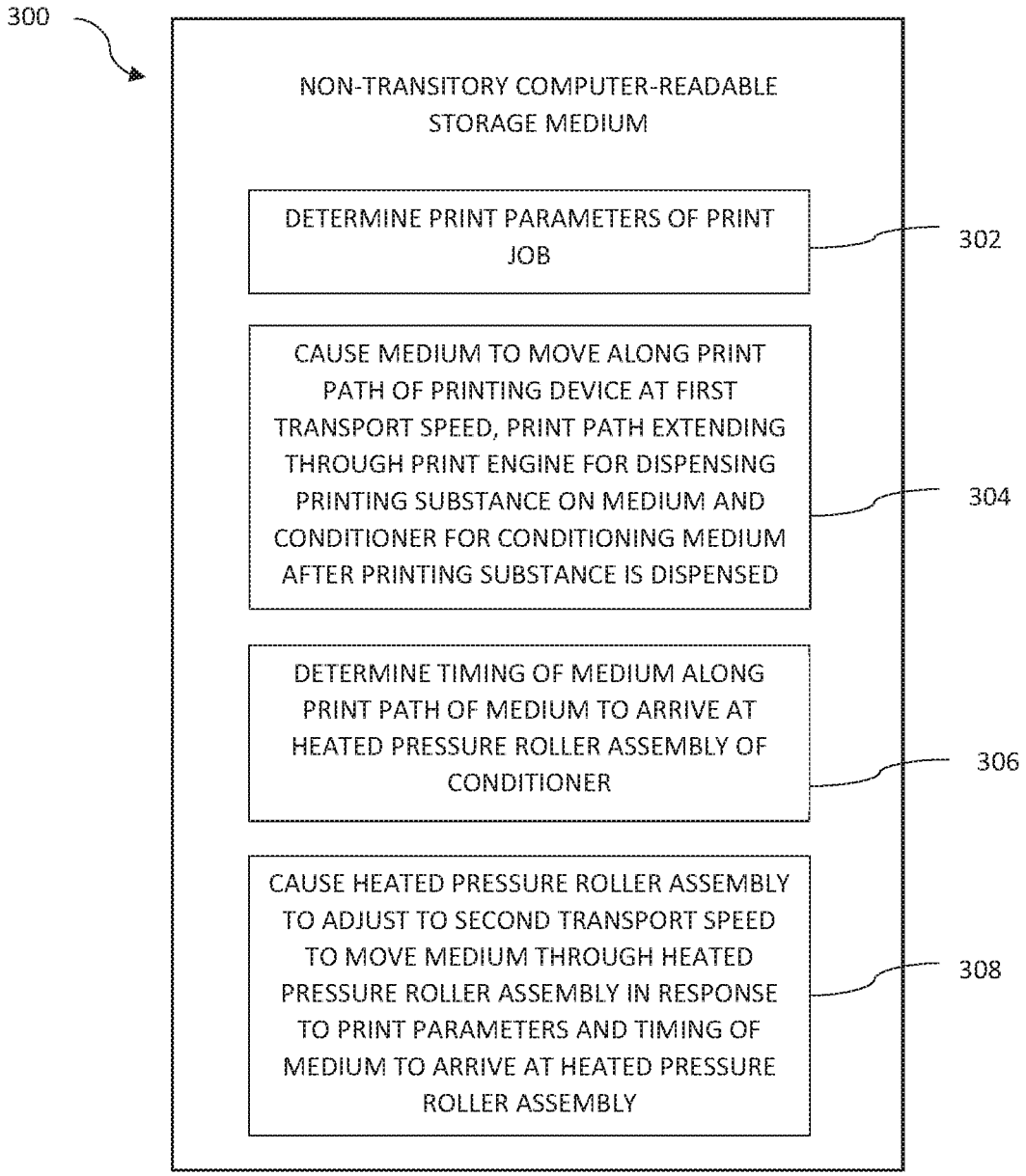
FIG. 3 is an example non-transitory computer-readable storage medium in accordance with aspect of the present disclosure.

FIG. 3 is a block diagram of an exampled non-transitory computer-readable storage medium 300 comprising a set of instructions executable by a processor in accordance with aspects of the present disclosure. In one example, the non-transitory computer-readable storage medium 300 is included in the memory of the imaging system and includes a set of instructions 302-308 executable by the processor. Instruction 302 is to determine a print parameter of a print job. Instruction 304 is to cause a medium to move along a print path of the printing device at a first transport speed, the print path extending through a print engine for dispensing a printing substance on the medium and a conditioner for conditioning the medium after the printing substance is dispensed. Instruction 306 is to determine a timing of the medium along the print path of the medium to arrive at a heated pressure roller assembly of the conditioner. Instruction 308 is to cause the heated pressure roller assembly to adjust to a second transport speed to move the medium through the heated pressure roller assembly in response to the print parameter and the timing of the medium to arrive at the heated pressure roller assembly. Additional instructions can also be included.

Figure 4:
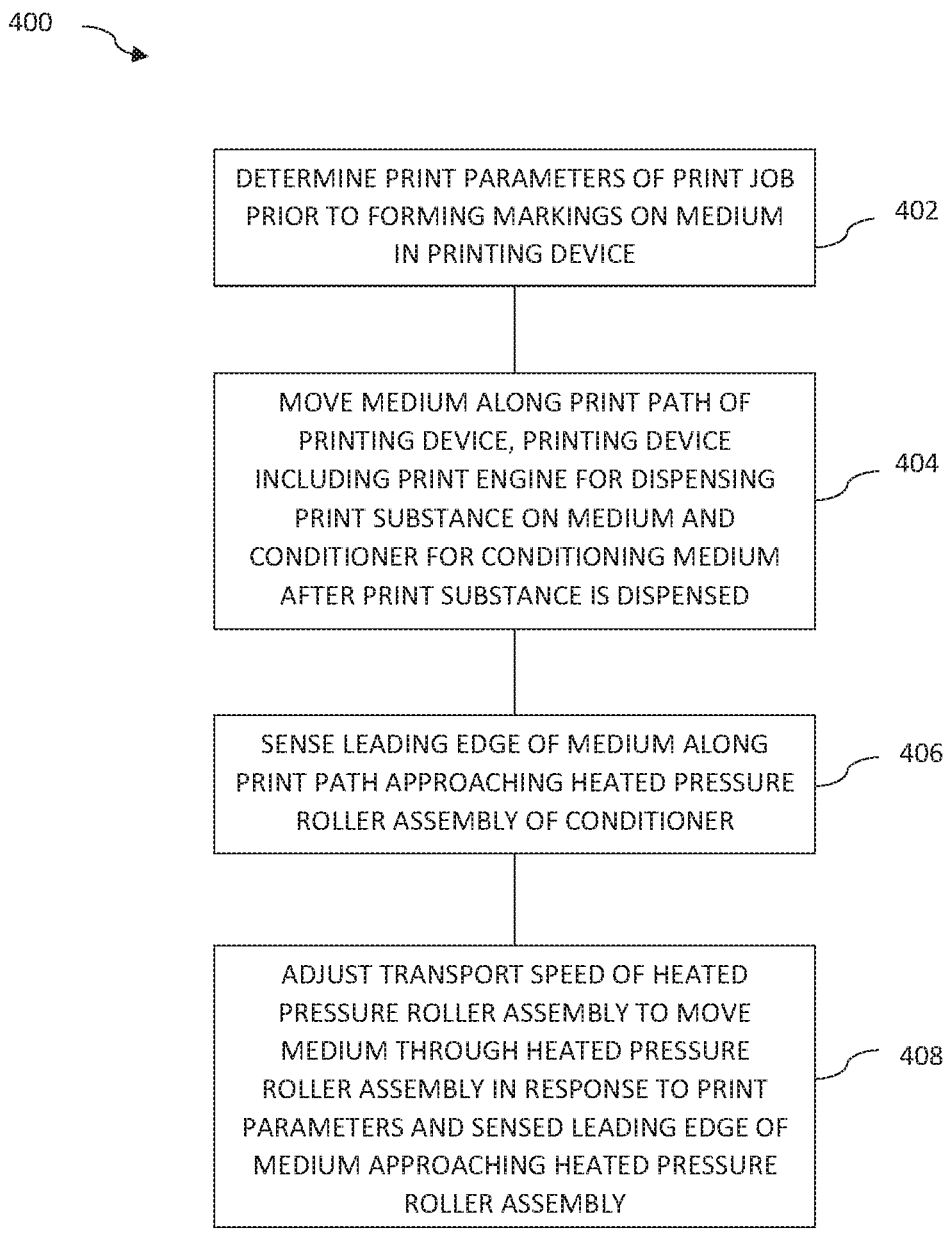
FIG. 4 is a flow diagram of an example method of operating a print system in accordance with aspects of the present disclosure.

FIG. 4 is a flow diagram of an example method 400 of operating a print system in accordance with aspects of the present disclosure. At 402, print parameters of a print job are determined prior to forming markings on a medium in a printing device. At 404, the medium is moved along a print path of the printing device, the printing device including a print engine for dispensing a print substance on the medium and a conditioner for conditioning the medium after the print substance is dispensed. At 406, a leading edge of the medium is sensed along the print path approaching a heated pressure roller assembly of the conditioner. At 408, a transport speed of the heated pressure roller assembly is adjusted to move the medium through the heated pressure roller assembly in response to the print parameters and the sensed leading edge of the medium approaching the heated pressure roller assembly.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A print system, comprising:

a memory to store instructions and print data of a print job;

a processor to execute the instructions fetched from the memory to:

reference print data of a print job, determine a print parameter of the print job, and generating a conditioning modifier based on the print data and the print parameter;

a print engine to dispense a print substance on a medium based on the print data to generate a printed medium; and a conditioner to apply heat and pressure to the printed medium, the conditioner including a pressure roller assembly; and a controller to selectively increase a transport speed of the pressure roller assembly based on the conditioning modifier and a position of the printed medium relative to the pressure roller assembly to selectively increase the speed of the printed medium through the conditioner.

2. The print system of claim 1, wherein the print parameter is a humidity of the print environment.

3. The print system of claim 1, comprising:

a sensor to sense a leading edge of the printed medium prior to entering the pressure roller assembly.

4. The print system of claim 1, comprising:

a finisher to receive the printed medium from the conditioner.

5. The print system of claim 1, wherein the print parameter is one of a medium type or a print substance type.

6. A non-transitory computer-readable storage medium comprising a set of instructions executable by a processor to:

determine a print parameter of a print job;

cause a medium to move along a print path of a printing device at a first transport speed, the print path extending through a print engine for dispensing a printing substance on the medium and a conditioner for conditioning the medium after the printing substance is dispensed;

determine a timing of the medium along the print path of the medium to arrive at a heated pressure roller assembly of the conditioner; and cause the heated pressure roller assembly to adjust to a second transport speed to move the medium through the heated pressure roller assembly in response to the print parameter and the timing of the medium to arrive at the heated pressure roller assembly, wherein the second transport speed is greater than the first transport speed.

7. The non-transitory computer-readable storage medium of claim 6, wherein the first transport speed is independent of the second transport speed.

8. The non-transitory computer-readable storage medium of claim 6, wherein the print parameter includes a humidity of the print environment.

9. A method of operating a printing system, comprising:

determining print parameters of a print job prior to forming markings on a medium in a printing device;

moving the medium along a print path of the printing device, the printing device including a print engine for dispensing a print substance on the medium and a conditioner for conditioning the medium after the print substance is dispensed;

sensing a leading edge of the medium along the print path approaching a heated pressure roller assembly of the conditioner; and adjusting a transport speed of the heated pressure roller assembly to move the medium through the heated pressure roller assembly in response to the print parameters and the sensed leading edge of the medium approaching the heated pressure roller assembly, wherein adjusting the transport speed includes selectively increasing the transport speed.

10. The method of claim 9, comprising:

moving the medium through the heated pressure roller assembly at the transport speed, the transport speed moving the medium faster than moving the medium through the print path.

11. The method of claim 9, comprising:

adjusting the transport speed for moving a next medium through the heated pressure roller assembly based on print parameters of a next medium.

12. The method of claim 9, wherein the medium is partially dry upon exiting the conditioner.

13. The method of claim 9, comprising:

maintaining the heated pressure roller assembly at a predetermined temperature.

* * * * *